United States Patent [19]

Smith

[11] 4,386,872

[45] Jun. 7, 1983

[54] DREDGE ENVIRON PROTECTION ASSEMBLY

[76] Inventor: Frederick A. Smith, 335 N. Palm Dr., Beverly Hills, Calif. 90210

[21] Appl. No.: 296,400

[22] Filed: Aug. 26, 1981

[51] Int. Cl.[3] ..... E02D 19/04; E02D 23/02

[52] U.S. Cl. ..... 405/13; 405/14; 405/203; 405/228

[58] Field of Search ..... 405/11, 13, 14, 66, 405/203, 224, 228; 37/54

[56] References Cited

U.S. PATENT DOCUMENTS

| | | | |
|---|---|---|---|
| 95,976 | 10/1869 | Bracher | 405/14 |
| 507,926 | 10/1893 | Peck | 405/13 |
| 936,638 | 10/1909 | Kirk | 405/14 |
| 1,966,974 | 7/1934 | Vermont | 405/13 |
| 2,063,514 | 12/1936 | Meem | 405/14 |
| 2,105,014 | 1/1938 | Segel | 405/11 |
| 4,016,726 | 4/1977 | Campbell et al. . | |
| 4,033,137 | 7/1977 | Geist . | |
| 4,110,990 | 9/1978 | Thompson et al. . | |
| 4,174,186 | 11/1979 | Kasai et al. . | |

*Primary Examiner*—David H. Corbin
*Assistant Examiner*—Nancy J. Pistel
*Attorney, Agent, or Firm*—Darrell E. Hollis

[57] ABSTRACT

A method and assembly for temporarily isolating an area within a waterway preparatory to dredging in order to prevent disturbed sediment from spreading throughout said waterway. A plurality of spaced support column assemblies are lowered from a barge outer hull into soil forming a periphery of the area to be dredged. A separate side panel member is then lowered between each pair of support columns and water is then removed from an area completely encircled by the side panel members and support column assemblies before the area is dredged. After dredging operations are completed within the area, water is then reintroduced into the area and the side panels and support columns are withdrawn.

24 Claims, 12 Drawing Figures

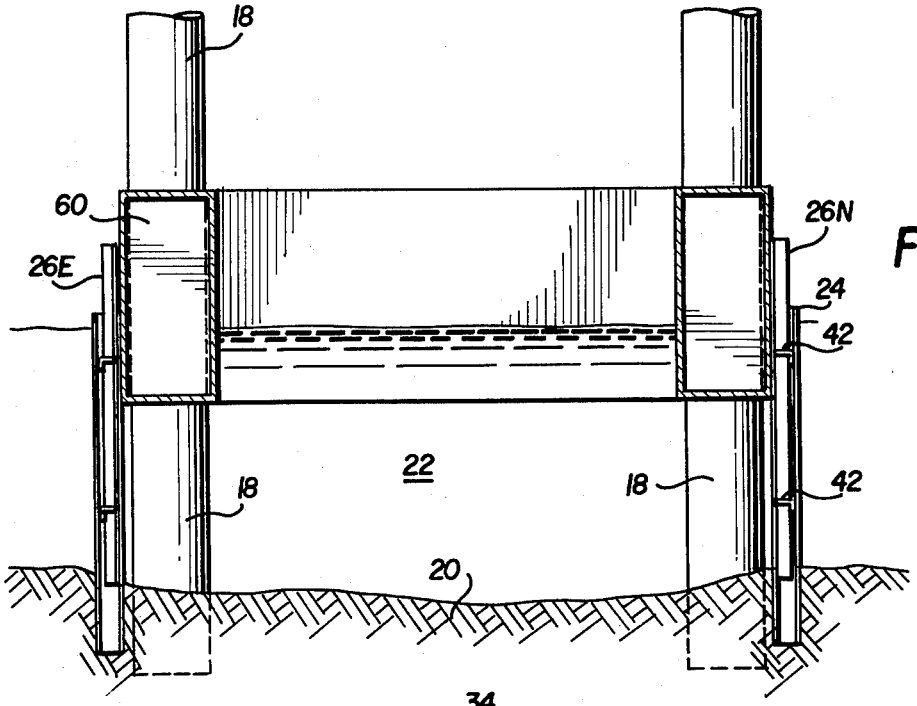
FIG. 3
FIG. 4A
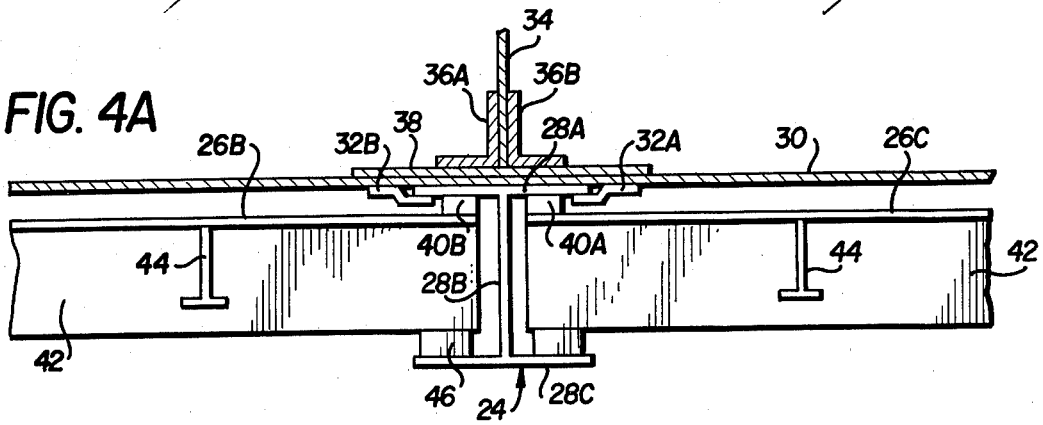
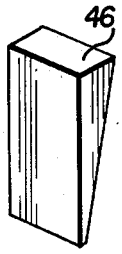
FIG. 4B
FIG. 5
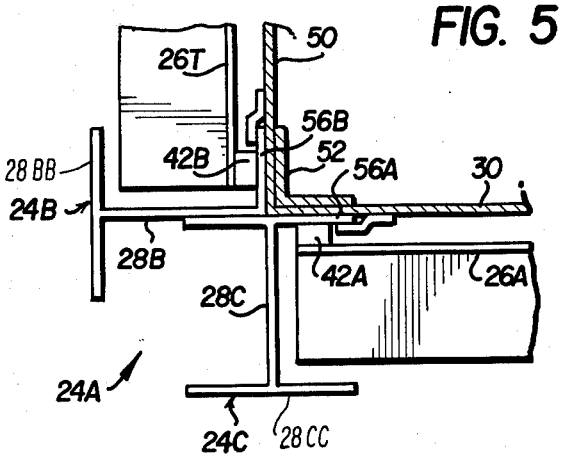
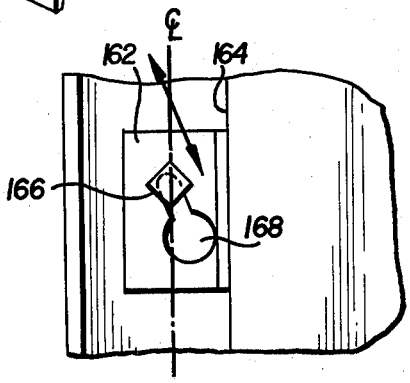
FIG. 11

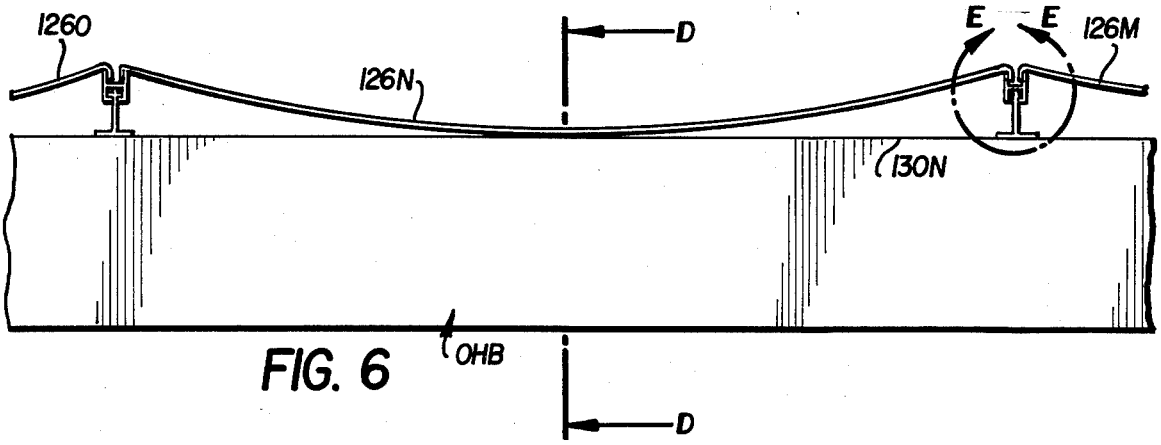
FIG. 6
FIG. 7
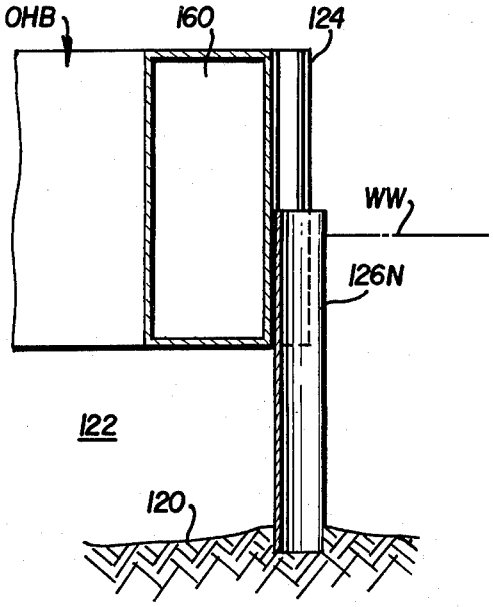
FIG. 8
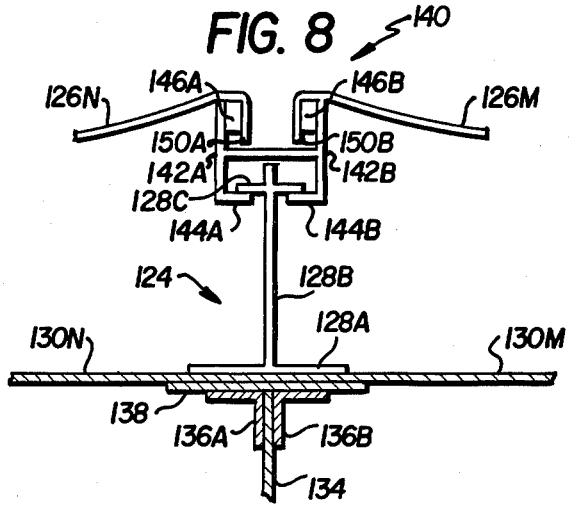
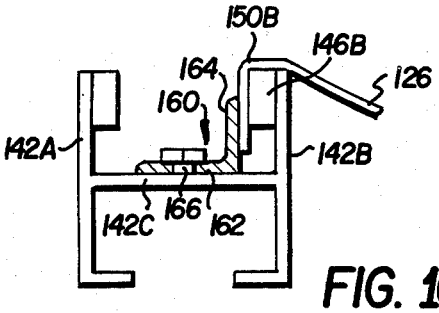
FIG. 10
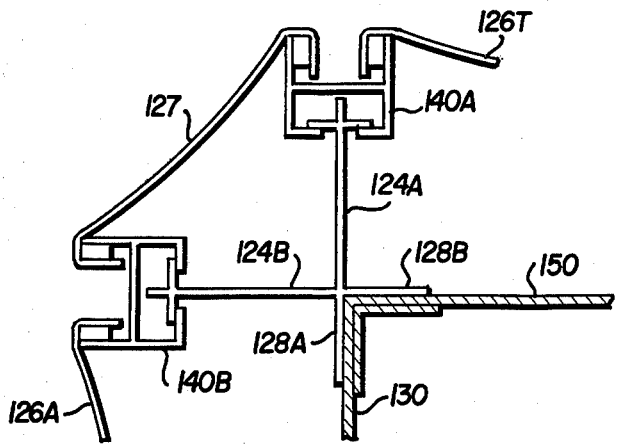
FIG. 9

DREDGE ENVIRON PROTECTION ASSEMBLY

STATEMENT OF GOVERNMENT INTEREST

The invention described and claimed herein may be manufactured and used by or for the Government of the United States of America for governmental purposes without the payment of royalties thereon or therefor.

DESCRIPTION

1. Technical Field

The present invention relates to a barge-mounted dredge protection assembly capable of isolating a portion of a waterway undergoing dredging from adjacent portions of the waterway, thereby preventing dredge disturbed sediment from spreading therebetween.

2. Background Art

The present invention relates to a barge mounted dredge protection assembly for use in protecting waterways from pollution generated during dredging operations.

During conventional dredging operations, claimshell buckets, dragline buckets or hydraulic dredges are often employed to remove underwater soil and thereby deepen a waterway. A long standing problem which confronts such dredging operations is how to remove the underwater soil without seriously polluting downstream portions of the waterway. In particular, it has long been known that removal of the underwater soil tends to distrub bottom sediment, with the disturbed sediment being carried downstream along with the normal river or channel current. Because the sediment often contains a variety of pollutants, the pollutants spread throughout downstream portions of the waterway. Even though great care may be taken during the dredging operation to disturb only the bottom soil necessary for deepening the waterway, the dredging action usually results in the turbidity of the sediment on the river or channel bottom when disturbed by such conventional dredging equipment.

As will become apparent from the following description, the present invention provides a barge mounted dredge protection assembly capable of preventing dredge disturbed sediment from polluting downstream portions of the waterway, regardless of the location of the dredging operation within the waterway.

DESCRIPTION OF THE INVENTION

In a preferred embodiment, a barge mounted dredge protection assembly formed in accordance with the present invention is floated to the required dredging area. A plurality of separate support column cassions are lowered from the barge into portions of the channel bottom distances sufficient to support the barge above the channel bottom without the aid of any water present within the channel. In other words, the separate column cassions function as stilts for supporting the barge a predetermined distance above the bottom surface of the channel.

The present invention further includes a plurality of separate panel support columns which are also lowered from the barge into the channel or river bottom to such a depth as is necessary to resist water pressure acting on separate panel members extending between each pair of adjacently disposed panel support columns. After the panel support columns are in position, a plurality of separate side panels are lowered end-to-end into the water, with the side panels completely surrounding the barge to enclose and isolate the water within the dredging area. Fluid-tight seals located between the side panels and the panel support columns ensure a fluid-tight enclosure is created within the closed area bounded by the side panels.

After the side panels are properly positioned such that water cannot flow into or out of the dredging area, the water present in the dredging area is removed and the channel bottom is dredged or excavated in a conventional manner for excavation within a large open caisson. By enclosing the dredging area within a plurality of side panels, disturbed sediment cannot spread to downstream portions of the channel, thereby significantly reducing the adverse affect of the dredging operation on the remaining river channel or similar waterway. Furthermore, since the dredging area is usually larger than the area of the barge, the dredging area is divided into barge-size segments which are excavated or dredged one segment at a time.

A significant benefit of the present apparatus and method is that any soil dredged or removed from the channel bottom after the water has been removed is relatively dry and usable for solid fill at a much earlier date after removal as compared with wet soluble material dredged from water-ways in the conventional manner. For example, it is known that such relatively wet channel bottom soil often takes many years to become load bearing dry fill. In comparison, the relatively dry material excavated in a manner consistent with the present invention can become load supporting as soon as the material is placed and compacted or graded in place with normal construction equipment.

BRIEF DESCRIPTION OF DRAWINGS

A preferred embodiment of the present invention can best be understood in conjunction with the attached drawings, wherein:

FIG. 3 is a partial cross-section of the barge mounted dredge protection assembly taken along the section A—A in FIG. 1 with panels 26E and 26N in the lower position;

FIG. 4A is a partial cross-section through a panel support column taken along section B—B in FIG. 1;

FIG. 4B is a perspective view of a wedge block employed with the panel support column of FIG. 4A;

FIG. 5 is a partial cross-section through an end column taken along section C—C in FIG. 1;

FIG. 6 is a partial plan view of a barge mounted dredge protection assembly formed in accordance with an alternative embodiment of the present invention;

FIG. 7 is a partial cross-section through the embodiment of FIG. 6, taken along section D—D; and section D—D is taken through same panels as Section A—A of FIG. 1;

FIG. 8 is a partial cross-section of a panel support column, and column bracket employed in the embodiment of FIG. 6, taken along section E—E;

FIG. 9 is a partial cross-section of an end support column bracket and two-end panel support columns employed in the embodiment of FIG. 6 as well as the two side panels and a corner closure panel;

FIG. 10 is a blown-up view of the clip and seal employed in the assembly of panel support columns shown in FIG. 8 and FIG. 9; and FIG. 11 is a front view of the clip employed in FIG. 10.

BEST MODE FOR CARRYING OUT THE INVENTION

The present invention provides an assembly and method of dredging waterways so as to protect downstream portions of the waterway from receiving pollution from the area being dredged.

Figure 1:
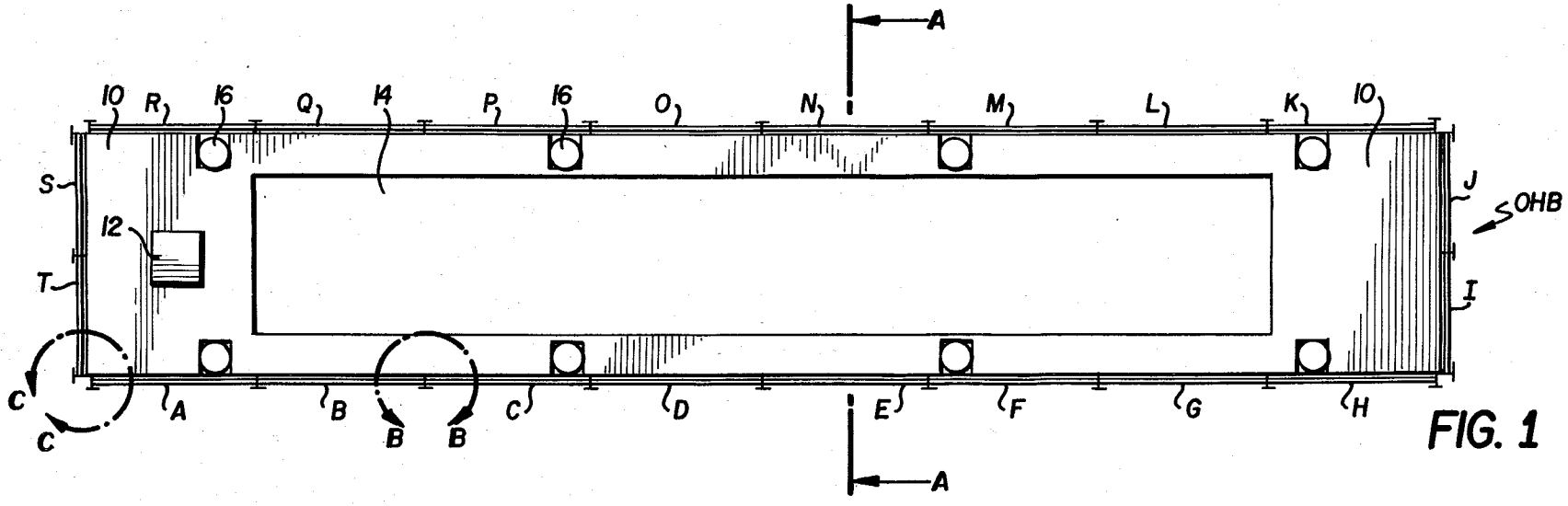
FIG. 1 is a plan view of an open hopper barge including a dredge protection assembly formed in accordance with a preferred embodiment of the present invention.

The assembly is preferably mounted on an open hopper type barge generally designated OHB in FIG. 1. Open hopper barge OHB includes a dredge deck 10 capable of supporting a conventional, deck-mounted dragline or similar excavator 12. Open hopper barge OHB includes a central open area 14 providing direct contact between excavator 12 and the channel bottom beneath the barge. During operation, a portion of the channel bottom positioned beneath opening 14 can be excavated without repositioning barge OHB in a manner which will become clear.

A plurality of separate cassion wells 16 are formed through opposite sides of barge OHB, with each well 16 receiving a separate dredge support column 18. Preferably, each column 18 has a substantially 4 foot diameter which is slightly less than the diameter of each cassion well 16, making it possible to lower a separate column 18 through each well 16 in accordance with a procedure set forth in DATB5-360-1 for SELF ELEVATING BARGES. Each column 18 is lowered through its respective well 16 until a portion of the column enters material forming a bottom surface 20 of a waterway generally designated WW in FIG. 2. Each column 18 is lowered through bottom surface 20 to a depth required to support barge OHB in substantially its predetermined position even without a quantity of water 22 between the bottom surface 20 and barge OHB. In other words, columns 18 act as stilts for supporting barge OHB above bottom surface 20 regardless of the presence of water 22 therebetween.

After the columns 18 have been lowered through their respective cassion wells 16, the columns 18 fixedly position the barge above the bottom surface 20 to be dredged. At this point, a plurality of separate panel support columns 24 are each lowered from an outer surface of the barge, until an end portion of each column 24 penetrates bottom surface 20. Each pair of adjacently disposed support columns 24 provide support for a side panel 26 extending therebetween. By surrounding the periphery of barge OHB with columns 24 and positioning a separate side panel 26 between each pair of adjacent columns 24, it becomes possible to enclose the water 22 located between bottom surface 20 and barge OHB.

Figure 2:
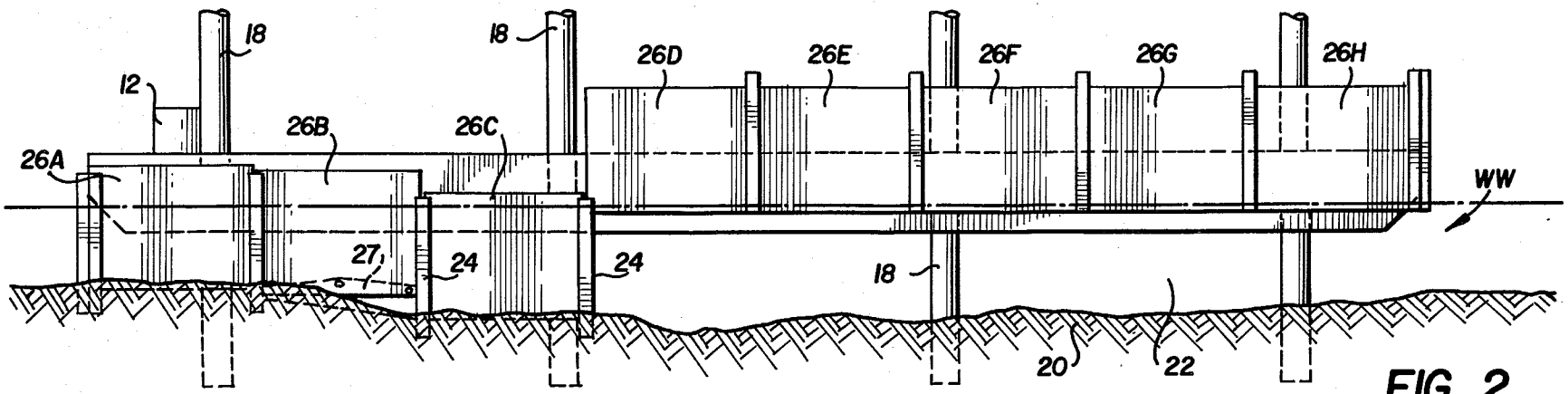
FIG. 2 is a side view of the barge mounted dredge protection assembly of FIG. 1.

As shown in FIG. 2, several of the side panels 26A, 26B and 26C extend from barge OHB through water 22 and penetrate bottom surface 20. Additional side panels 26D–H are arranged on barge OHB prior to lowering through water 22. Each of the side panels is preferably formed of steel plate having a thickness of ⅜". Likewise if the barge OHB is 192 feel long by 11 feet high, each side panel is preferably 24 feet long and 18 feet high. It is to be understood that the size and composition of panels 26 is considered to be a design choice and is no way intended to be limited to the materials and sizes discussed hereabove.

FIG. 4A shows a typical panel support column 24 with a pair of side panels 26B and 26C extending outwardly from opposite sides thereof. Support column 24 has an I-shaped configuration, with a first side or column flange 28A extending adjacent an outer hull 30 of barge OHB. Column 24 further includes a connecting portion or column web 28B extending in a perpendicular direction from the first side 28A and joining a second side column flange 28C extending parallel to side 28A. A pair of bent clip plates 32A and 32B are each fixedly attached to an outer surface of hull 30 and are spaced from one another a distance such that opposite end portions of first side, flange 28A project between each clip and hull frame 30. Each bent clip plate 32A and 32B has a steplike cross-sectional configuration for overlapping first side 28A of column 24. As a result, each pair of plates 32A and 32B function as guides to allow a column 24 to slide adjacent to hull 30 without moving outwardly from hull 30. A plurality of separate pairs of similarly constructed bent clip plates 32A and 32B are vertically spaced along the path of travel of each column 24 in order to provide guidance and support for each column 24 relative to hull 30.

As noted in FIG. 4A, column 24 extends outwardly from a location on hull 30 which includes a bulkhead plate 34 extending inwardly from hull 30. By arranging column 24 adjacent to bulkhead plate 34, a condition of maximum support for column 24 and panels 26B and 26C is achieved. Bulkhead plate 34 contacts a stiffner plate 38, itself attached to an interior surface of hull 30. Finally, a pair of L-shaped brackets 36A and 36B extend between opposite sides of bulkhead plate 34 and stiffner plate 38 to provide additional lateral support.

A pair of rubber sealing strips 40A and 40B are attached to interior surface portions of first side, flange, 28A, such that each sealing strip confronts an edge portion of a separate side panel 26. Each sealing strip 40A and 40B is formed of a resilient material capable of being deformed when compressed between first side 28A and one of the side panels 26. As a result, a watertight seal is achieved between column 24 and each of the panels 26B and 26C. In a like manner, sealing strips 40A and 40B are mounted on each column 24 and serve to provide a fluid-tight seal with a pair of respective panels extending in opposite directions therefrom.

It is respectfully noted that sealing strips 40A and 40B could be attached to opposite edge portions of each side panel, rather than to each column 24. In either case, the water pressing against each panel 26 achieves an ever increasing sealing pressure against strips 40A and 40B as the water within the dredging area is pumped out.

Turning again to FIG. 4A, it is noted that each side panel 26B and 26C includes a horizontally disposed stiffner angle 42 extending outwardly therefrom, as shown in FIG. 3, with the outer leg of the angle turned down to provide additional stiffness to panel and to avoid holding water. In fact, each panel 26 is constructed with a plurality of vertically spaced stiffner angles 42 each arranged in a horizontal plane and extending outwardly from the panel surface. In addition, each panel 26 may include a plurality of spaced T columns 44, each disposed in a vertical plane and extending outwardly from hull 30. Stiffner angles 42 and T columns 44 each provide added support to the panels 26 in order to resist fluid pressures generated by water surrounding the space defined by the interconnected panels 26.

A wedge-shaped member 46 is preferably positioned between inside surfaces of side 28C and the vertical leg of each horizontal stiffner angle 42 in order to fixedly position a panel 26 relative to column 24. Preferably, each wedge-shaped member 46 is formed of hard wood or metal material with wire or permanent cordage ties to panels to prevent droppings.

A typical corner of barge OHB is shown in FIG. 5 to include a portion of side hull 30 and an end hull of the barge designated at 50. Side hull 30 and end hull 50 extend substantially perpendicular to one another and an L-shaped stiffner plate 52 is welded into engagement with interior surface portions of both hull portions in order to provide additional support. A column 24A is shown as a corner column made up from 2 steel columns 24B and 24C (by cutting off the outer leg of the inner flange of column 24B and welding both steel columns together to form a watertight joint at the junction of side hull 30 and end hull 50) and having a first side 28A with a flange portion 56A extending adjacent to hull 30, and a further flange portion 56B extending adjacent to hull 50. In a like manner, corner column 24B includes a column web side 28B with exterior flange 28BB. Corner column 24C further includes a column web 28C and exterior flange 28CC all being part of corner column 24A. As a result, column 24A provides support for perpendicularly extending panels 26A and 26T. A resilient strip 42A positioned between panel 26A and an interior surface of the flange 56A attached to column 24A creates a fluid-tight connection similar to a fluid-tight connection created by a resilient strip 42B compressed between panel 26T and an interior surface of flange 56B attached to column 24A.

Referring now to FIG. 3, it is noted that barge OHB includes hollow side compartments 60 which may be selectively filled with water to provide a downward pressure for driving columns 18 and 24 into bottom surface 20. Alternatively, side compartments 60 may be filled with air in order to raise the columns at completion of the dredging or excavating operation.

Any conventional power source may be employed for lowering and raising columns 18, 24 and panels 26. For example, power operated jacks may be employed for driving the columns and panels into the bottom surface 20. Alternatively, the columns 18 and 24 may be lowered by: (1) a separate barge mounted crane or pile driving rig with a head bracket to distribute the pressure for the panels 26; (2) a hydraulic jack or a system of hydraulic rams and jacks; (3) compressed air operated jacks, or (4) flooding and then pumping out the water tight compartments 60 on a repeated basis to first sink columns 18, then columns 24 and finally panels 26. Regardless of the power source, upon final assembly, a continuous fluid-tight barrier extends from the hull of barge OHB into bottom surface 20, with the barrier completely surrounding the dredging area. At this point, the water located within the enclosed barrier is removed by pumping or the like, leaving the dry bottom surface ready for excavation.

If bottom surface 20 is inclined relative to a horizontal plane, one or more extension panels 27 may be attached to a bottom portion of panels 26 so as to block the flow of water beneath the barrier. Bolts may be employed for attaching the extension panels 27 to the rectangularly-shaped panels 26 as required.

A further embodiment of the present invention is shown in FIGS. 6–11, wherein a plurality of curved panels 126 are employed in place of the substantially flat panels 26 discussed hereabove. Each panel 126 has a curved configuration similar to a conventional water or fuel tank and is mounted on a barge OHB such that an intermediate portion 127A of panel 126 is positioned closer to hull 130 than opposite end portions 127B and 127C of panel 126. Because of the smoothly concave configuration of the panels 126, it is possible to eliminate horizontal and vertical stiffner members 42 and 44, respectively.

A plurality of column support brackets 124 are positioned between confronting end portions of adjacently positioned curved panels 126 for the express purpose of supporting panel support columns 140 which in turn support the water pressures on the curved panel 126 in their proper positions relative to barge OHB. In particular, each support column bracket 124 includes a first side or inboard side or column flange 128A welded to an outer surface of hull 130, as best shown in FIG. 8. Each support column bracket 124 further includes a connecting portion 128B extending substantially perpendicular to first side 128A and joining a second side 128C extending substantially parallel to side 128A. Mounted on an opposite side of hull 130 from a column bracket 124 is a bulkhead plate 134 which abuts a stiffner plate 138 and is supported on either side by a pair of L-shaped brackets 136A and 136B attached to bulkhead plate 134 as well as plate 138.

A separate H-shaped column assembly 140 encloses the outboard or second side 128C of each column bracket 124 such that confronting end portions of adjacently disposed panels 126 each fit between parallel extending arm portions 142A and 142B of column 140. Furthermore, arm portions 142A and 142B include end portions 144A, and 144B extending toward one another a distance sufficient to overlap side 128C of column bracket 124. As a result, end portions 144A and 144B prevent column 140 from inadvertently separating from column bracket 124.

A pair of resiliently deformable sealing strips 146A and 146B are attached to confronting surface portions of arm portions 142A and 142B, respectively, such that each resiliently deformable strip is compressed between a wall of column 140 and an L-shaped end portion 150A or 150B of curved panel 126N or 126M, respectively.

As shown in FIG. 10, an L-shaped wedging plate 160 is mounted on a connecting portion 142C or the web of column 140 extending between flanges or arm portions 142A and 142B. Wedging plate 160 includes a first side 162 abutting connecting portion 142C and a second side 164 abutting the L-shaped end 150B of panel 126. A square headed bolt 166 is welded to the connecting portion 142C, with the sides of bolt 166 forming an angle of substantially 45° to a centerline CL of connecting portion 142C as best shown in FIG. 11. In addition, a hole 168 is formed through the first side 162 of wedging plate 160. During assembly, wedging plate 160 is positioned such that bolt 166 extends through opening 168. Wedging plate 160 is then hammered down on the stem portion of bolt 166, causing sideways movement of plate 160 in the direction of the arrows R—R in FIG. 11. This sideways movement of plate 160 acts to wedge side 164 into ever tighter engagement with the L-shaped end portion 150B of panel 126. It is noted that a second wedging plate, not shown, is mounted in an opposite direction from plate 160 for biasing L-shaped end portion 150A toward arm portion 142A of column 140.

Referring now to FIG. 9, a corner connection of the panels 126 is shown in detail. In particular, a first column bracket 124A includes an end portion 128A attached to a side hull 130 and a second perpendicularly extending column bracket 124B included and end portion 128B attached to an end hull portion 150. An H-shaped column 140A is mounted on column bracket 124A and an identically shaped column 140B, mounted on column bracket 124B. A connecting panel 127 includes end portions extending into brackets 140A and 140B, with panel 127 serving to enclose the corner portion of OHB. Each column 140A and 140B includes a pair of resilient sealing and also receives an end portion of an adjacent panel 126A or 126T, respectively, in a manner described hereabove.

In order to lower and raise the columns 140A and 140B as well as the panels 126, hollow compartments 160 may be filled with water or with air in the barge OHB as shown in FIG. 7 and described on page 9 for FIG. 3.

The present invention is not intended to be limited to the above discussed embodiments, rather, the present invention is intended to be limited only by the scope of the claims following hereafter.

I claim as my invention:

1. A barge mounted protection assembly for isolating a portion of a waterway preparatory to dredging said portion, thereby preventing sediment disturbed during dredging from polluting a remaining portion of said waterway, and comprising:

a plurality of separate support column assemblies spaced about an outer hull of said barge, with each support column assembly projecting from said outer hull into soil forming a bottom surface of said waterway;

a plurality of separate side panel members, each panel member having a pair of opposite end portions slidably engaging a pair of adjacently disposed support column assemblies, wherein said plurality of side panel members and plurality of support column assemblies interposed therebetween form a continuous barrier encircling said barge and projecting from said barge to the soil forming the bottom surface of said waterway; and separate sealing means compressed between confronting end portion of each side panel member and support column assembly for preventing water from leaking through said continuous barrier, even though water is removed from said isolated portion preparatory to dredging operations.

2. A protection assembly according to claim 1, wherein each support column assembly includes a substantially vertically extending first flange portion resting against the outer hull of said barge;

each support column assembly further includes a second flange portion extending parallel to and spaced from said first flange portion, and each support column assembly also includes a connecting portion extending between and joining said first and second flange portions, respectively.

3. A protection assembly according to claim 2, wherein each support column assembly has a substantially I-shaped configuration.

4. A protection assembly according to claim 2, wherein a first side panel member includes an end portion extending between said first and second flange portions and confronting a first side of said connecting portion;

a second side panel member includes an end portion also extending between said first and second flange portions and confronting a second opposite side of said connecting portion, whereby said first and second side panel members are disposed end-to-end on opposite sides of said connecting portion.

5. A protection assembly according to claim 1, wherein a plurality of said side panel members are disposed end-to-end about said outer hull, each side panel member having a planar cross-sectional configuration.

6. A protection assembly according to claim 2, wherein a plurality of said side panel members have concave cross-sectional configurations.

7. A protection assembly according to claim 5, wherein each of said plurality of side panel members includes at least one outwardly extending stiffner angle.

8. A protection assembly according to claim 7, wherein each of the said plurality of side panel members includes a plurality of T-shaped vertically disposed stiffner columns extending outwardly therefrom, wherein each stiffner column has a longitudinal axis extending substantially perpendicular to a stiffner angle.

9. A protection assembly according to claim 7, wherein a plurality of separate stiffner angles extend outwardly from each side panel member, said stiffner angles being vertically spaced from one another.

10. A protection assembly according to claim 7, wherein a separate wedge-shaped locking member extends between each second flange portion and a confronting surface of an adjacent stiffner angle for biasing each side panel member toward first flange portions of said support column assemblies to lock each side panel member against movement relative to said barge.

11. A protection assembly according to claim 2, wherein said separate sealing means comprises a separate strip of resiliently deformable material extending between each first flange portion and confronting surface portions of each side panel member.

12. A protection assembly according to claim 11, wherein each strip of resiliently deformable material is fixedly attached to a side of a respective first flange portion for compression against a confronting side panel member.

13. A protection assembly according to claim 11, wherein one strip of resiliently deformable material is fixedly attached to each respective side panel member for compression against a confronting first flange portion.

14. A protection assembly according to claim 2, wherein separate guide means are mounted on the outer hull of said barge for slidable guiding each support column assembly into soil forming a bottom surface of said waterway.

15. A protection assembly according to claim 14, wherein each guide means comprises a separate pair of bent clip plates fixedly attached to the outer hull at locations corresponding to each support column assembly;

each bent clip plate having a step-shaped configuration with an end portion fixedly attached to the outer hull and a further end portion overlapping a first flange portion of a support column assembly.

16. A protection assembly according to claim 15, wherein each pair of bent clip plates are aligned with one another to form an opening having a width substantially equal to a width of said first flange portion of said support column assembly.

17. A protection assembly according to claim 16 wherein a plurality of pairs of bent clip plates are vertically aligned with one another to form a substantially vertically extending guide slot for each support column assembly toward and away from the soil forming a bottom surface of said waterway.

18. A protection assembly according to claim 2, wherein each support column assembly further includes a substantially H-shaped bracket extending outwardly from a respective second flange portion, and each side panel member includes a pair of hook-shaped end portions each extending into an H-shaped bracket mounted on second flange portions of each support column assembly.

19. A protection assembly according to claim 18, wherein said separate sealing means comprises a separate strip of resiliently deformable material compressed between each hook-shaped end portion and an interior side portion of a confronting H-shaped bracket.

20. A protection assembly according to claim 19, wherein a separate fastening clip is slidably attached to each H-shaped bracket for compressing each hook-shaped end portion of each side panel member into contact with a strip of said resiliently deformable material.

21. A method of temporarily isolating a portion of a waterway to allow for dredging of said isolated portion without spreading sediment and the like from said isolated portion to a remaining portion of said waterway, comprising the steps of:

lowering a plurality of separate support column assemblies from an outer hull of a barge into soil forming a bottom surface of said waterway, said columns projecting from said hull into the soil and forming a periphery of a waterway area to be isolated and dredged;

lowering from said barge a separate side panel member between each pair of adjacently disposed support column assemblies to form a continuous barrier completely encircling said barge and the waterway portion to be dredged and projecting from said barge to the soil; and removing all water from within the completely encircled waterway portion preparatory to dredging said isolated portion.

22. A method according to claim 21, including the step of lowering a plurality of barge support columns from said barge into soil forming a bottom surface of said waterway prior to lowering said plurality of support column assemblies.

23. A method according to claim 22, including the step of temporarily filling at least one hollow compartment on said barge with water to press said barge against said barge support columns and thereby drive said barge support columns into said soil.

24. A method according to claim 20, including the step of positioning an irregularly-shaped side panel member between each side panel member and non-planar region of soil forming a periphery of said isolated portion.

* * * * *